United States Patent [19]

Harbaugh

[11] 4,382,330

[45] May 10, 1983

[54] COIN WRAPPER CUTTING TOOL

[76] Inventor: Kenneth H. Harbaugh, Cite Ouest G, 1196 Gland, Switzerland

[21] Appl. No.: 193,049

[22] Filed: Oct. 2, 1980

[51] Int. Cl.[3] ..... B67B 7/30; B26B 29/00; G07D 9/00

[52] U.S. Cl. ..... 30/124; 133/1 R; 30/294; 30/2

[58] Field of Search ..... 30/287, 2, 286, 289, 30/294, 279 R, 290, 291, 299, 111, 92, 124; 133/1 R

[56] References Cited

U.S. PATENT DOCUMENTS

| | | | |
|---|---|---|---|
| 698,567 | 4/1902 | Sibley | 30/289 |
| 2,122,263 | 6/1938 | Pinter | 30/286 |
| 2,730,800 | 1/1956 | Bailey | 30/2 |
| 3,667,122 | 6/1972 | Black | 30/286 |
| 3,781,987 | 1/1974 | Gentscheff . | |
| 3,965,575 | 6/1976 | Stunger | 30/294 |
| 4,038,746 | 8/1977 | Bromley . | |
| 4,040,183 | 8/1977 | Cassier . | |
| 4,086,698 | 5/1978 | Sparks | 30/2 |
| 4,091,537 | 5/1978 | Stevenson, Jr. | 30/286 |
| 4,106,196 | 8/1978 | Smithline . | |
| 4,333,234 | 6/1982 | Smith et al. | 30/2 |

FOREIGN PATENT DOCUMENTS 190402 12/1922 United Kingdom ..... 30/290

*Primary Examiner*—Harold D. Whitehead
*Assistant Examiner*—Robert A. Rose
*Attorney, Agent, or Firm*—James A. Wong

[57] ABSTRACT

A coin wrapper cutting tool comprising a principal body portion on which a cutting blade for cutting crimped end portions of wrappers of packaged rolls of coins and an element for shielding the blade when cutting is not required are assembled; the principal body portion including at least one shoulder supporting the blade and shielding element, the shoulder also having a side beyond which the blade projects. The principal body portion also including a platform portion extending from a back side and against which platform portion the end of a packaged roll of coins may be pressed. The platform portion further having an abutment surface extending generally parallel to the shoulder and blade, but closer to the back side of the principal body portion than the blade by an amount facilitating cutting the crimped end portions of wrappers of packaged rolls of coins without interference from coins in such packages.

10 Claims, 4 Drawing Figures

FIG. 1.
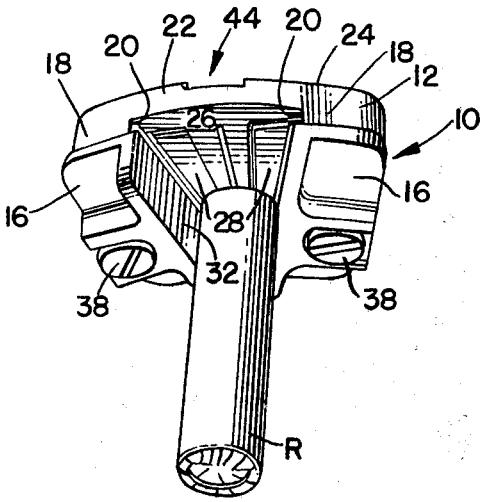
FIG. 2.
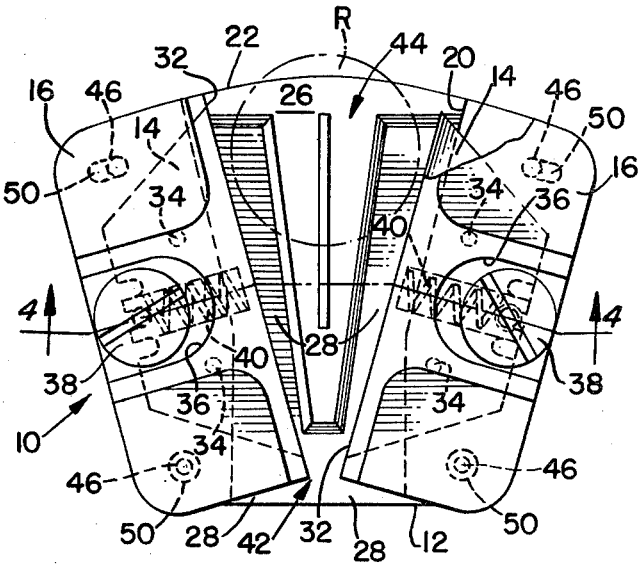
FIG. 4.
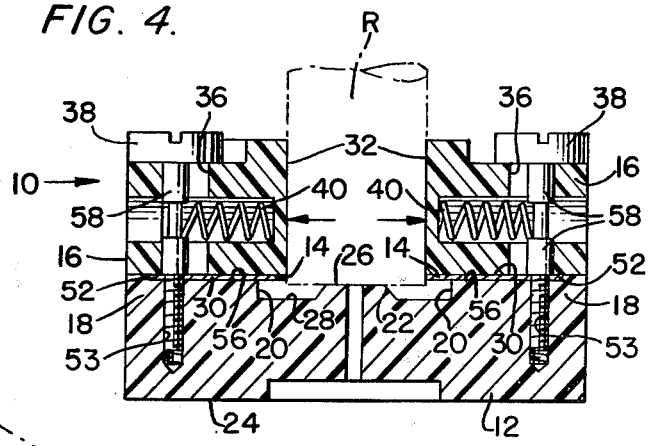
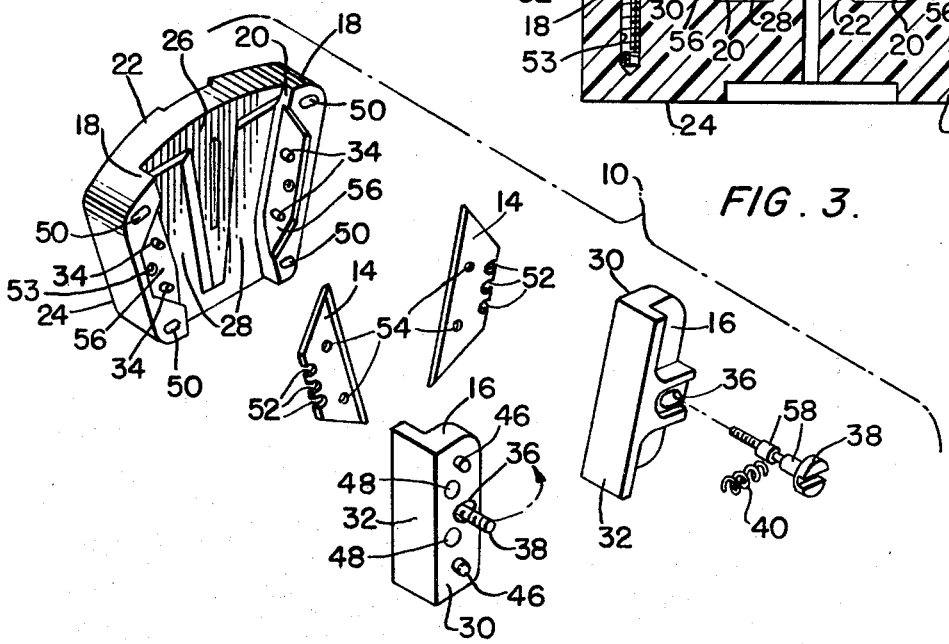
FIG. 3.

COIN WRAPPER CUTTING TOOL

BACKGROUND OF THE INVENTION

1. Field of the Invention

This invention relates to a paper cutting tool and more particularly to a tool, such as might be found with art in Class 30, Subclasses 2, 294, and 296, for cutting a paper wrapper of a packaged roll of coins.

2. Description of the Prior Art

Coin wrapper cutting tools known in the prior art include tools of the type which cut through the wrapper of a roll of coins longitudinally from one end to the other, as exemplified by U.S. Pat. No. 4,106,196 (Smithline); and the type which slit the sidewall of the wrapper circumferentially, preferably adjacent one end of the roll so that the crimped end portion may be removed, as exemplified by U.S. Pat. No. 3,781,987 (Gentscheff).

SUMMARY OF THE INVENTION

The present invention constitutes a new and improved coin wrapper tool of the type which will cut the wrapper circumferentially adjacent one end of the roll of coins.

An object of the present invention is to provide a new and improved tool which will facilitate opening a packaged roll of coins without any tearing effort or necessity for preformed tear strip or perforations in the wrapper.

Another object of the present invention is to provide a new and improved tool which will ensure that the crimped end portion of a roll of coins will be cut without scratching or nicking any of the coins.

It is another object of this invention to provide a new and improved tool for cutting a coin wrapper wherein the cutting blades are normally covered to prevent injury to personnel.

It is further object of this invention to provide a new and improved cutting tool which will readily adjust to accommodate rolls of various sizes of coins.

Other objects and advantages of the present invention will be apparent from the following description taken in conjunction with the accompanying drawings.

BRIEF DESCRIPTION OF THE DRAWINGS

The present invention will be readily understood by the reader on review of the accompanying drawings of which:

FIG. 1 represents a view in perspective of the disclosed cutting tool with a roll of coins received therein so that the crimped end portion of the wrapper may be cut;

FIG. 2 represents a top plan view of the cutting tool of FIG. 1 mounted on a horizontal surface;

FIG. 3 represents an exploded view in perspective of the cutting tool of FIGS. 1 and 2; and FIG. 4 represents a sectional view of the disclosed invention taken along section 4—4 and looking in the direction of the arrows in FIG. 2.

DETAILED DESCRIPTION OF A PREFERRED EMBODIMENT

Referring now in detail to FIGS. 1 and 3 of the drawings, the reader will readily appreciate the disclosed invention relates to a coin wrapper cutting tool 10 comprising in combination base or principal body portion 12, means in the form of blades 14 for cutting crimped end portions of wrappers of packaged rolls R of coins, and means in the form of slidable plates 16 for shielding the blades 14 when cutting is not required. The base or principal body portion 12 includes the spaced-apart shoulders 18, each supporting a cutting blade 14 and a shield 16 normally covering the blade 14 from exposure. Each shoulder 18 has a side 20 beyond which cutting blade 14 projects. Base or principal body portion 12 includes a stationary platform portion 22 extending forwardly from a back side 24. When the crimped end portion of a packaged roll R of coins is to be cut, it is pressed against the platform portion 22 on an abutment surface 26 thereof extending generally parallel to an upper surface on the shoulder 18 and to cutting blade 14, but closer to the back side 24 of base or principal body portion 12 than cutting blade 14 by an amount facilitating cutting the crimped end portions of wrappers of packaged rolls R of coins without interference from coins in such packages as may be readily visualized in FIG. 4. Each of the plates or shields 16 as assembled are slidably mounted on the upper surface on shoulder 18.

Platform portion 22 is formed with a grooved or undercut passage 28 between abutment surface 26 and each shoulder 18 for reception of end portions or material cut from a packaged roll R of coins. Each shield 16 includes a covering surface 30 overlying cutting blade 14 and a fence portion 22 extending normal to covering surface 30 and away from the respective stationary cutting blade 14. To maintain cutting blades 14 in cutting position, holding means in the form of pins 34 extend from shoulder 18 into shield 16. Each shield 16 is formed with an oversized bore 36 through which a retaining screw 38 extends through to base 12 to secure the shield 16 on base 12 with oversized bore 36 facilitating movement of shield 16 between positions covering and uncovering cutting blade 14. Biasing means in the form of a coil spring 40 is disposed against each retaining screw 38 and within the respective oversized bore 36 to yieldably bias shield 16 toward a normally covering position over cutting blade 14. The grooved or undercut passages 28 and adjacent shoulders 18 are arranged on remote or opposite sides of abutment surface 26 so that pairs of cutting blades 14 and shields 16 are disposed on shoulders 18 in mirror image to corresponding elements.

As may be seen in FIGS. 1 and 2, shields 16 are arranged at an angle to each other so that the respective fence portions 32 thereof diverge from a substantially closed rear end 42 to a spread-apart entrance 44 into which roll R of coins may readily be inserted with its end pressed against abutment surface 26 and its side against fence portions 32 as such a roll R of coins is moved toward substantially closed rear end 42 to expose cutting blades 14 for cutting operation when springs 40 are compressed and shields 16 yield in the direction of the arrows in FIG. 4. Also, as may be appreciated in FIG. 4, cutting blades 14 are each supported on one of the shoulders 18 in a plane generally parallel to abutment surface 26 and at a distance therefrom on the order of the approximate thickness of the crimped end portion of wrappers of packaged rolls R of coins so that when the crimped end portion of the wrapper is cut, none of the coins will be nicked, scratched, or damaged and the blades 14 also will not be damaged.

Each shield 16 is provided with a plurality of guide pin elements 46 on covering surface 30 and oversized recesses 48 while each shoulder 18 is also formed with a plurality of oversized recesses 50. In assembly the guide pin elements 46 extend within the oversized recesses 50 of shoulders 18, and the holding pins 34 extend within the oversized recesses 48 of shields 16, while retaining screws 38 extend within oversized bores 36 so that the oversized recesses 50, oversized recesses 48, and oversized bores 36 will cooperatively accommodate guide pin elements 46, holding pins 34, and retaining screws 38, respectively, during movement of shields 16 between positions covering and uncovering blades 14, which, as may be seen FIG. 2, include cutting edges extending along intersecting lines.

Each blade 14 includes a plurality of notches 52 on its back edge. One of the notches 52, as assembled in the cutting tool 10, is in registration with a hole 53 in shoulder 18 and with oversized bore 36 in shield 16. Each retaining screw 38 passes through an oversized bore 36, a notch 52, and a hole 53 to clamp a blade 14 and a shield 16 on the base 12. To accommodate blade 14, an undercut seat 56 is formed in shoulder 18 in which blade 14 is held in stationary position by pins 34. To enhance continuous contact between springs 40 and retaining screws 38, integral collar portions 58, 58 are formed on the shank of each retaining screw on opposite sides of a reduced diameter portion against which spring 40 abuts in captive relationship.

To gain access to the contents of a roll R of coins with the cutting tool according to the disclosed invention, one needs only to place the end of the roll R having a crimped end portion against abutment surface 26 at entrance 44, move the roll R toward substantially closed rear end 42 with the crimped end of roll R still against abutment surface 26 until side portions of roll R come tangentially against fence portions 32, 32 until fence portions compress springs 40, 40 in the direction of the arrows in FIG. 4 to uncover cutting blades 14, after which roll R is pressed firmly against blades 14 and rotated about its longitudinal axis with the crimped end of roll R still against abutment surface 26 to thus sever the crimped end portion from the wrapper of roll R without nicking or scratching any of the coins or damaging either of the blades 14, 14.

It will be obvious to those skilled in the art that various changes may be made without departing from the scope of the invention and the invention is not to be considered limited to what is shown in the drawings and described in the specification.

What is claimed is:

1. A coin wrapper cutting tool comprising in combination:

a. base or principal body portion;

b. means for cutting crimped end portions of wrappers of packaged rolls of coins; and c. means for shielding said cutting means when cutting is not required;

wherein said base or principal body portion includes at least one shoulder supporting said cutting means in stationary position and said shielding means normally covering said cutting means from exposure, said shoulder having a side beyond which said cutting means projects; also wherein said base or principal body portion includes a stationary platform portion extending forwardly in fixed relationship to said cutting means from a back side and against which platform portion the end of a packaged roll of coins may be pressed; and further wherein said platform portion is formed with an abutment surface extending generally parallel to an upper surface on said shoulder and to said cutting means but closer to the back side of said base or principal body portion than said cutting means by an amount facilitating cutting the crimped end portions of wrappers of packaged rolls of coins without interference from coins in such packages.

2. The cutting tool as defined in claim 1, wherein said platform portion is formed with a grooved or undercut passage between said abutment surface and said shoulder for reception of end portions cut from a packaged roll of coins.

3. The cutting tool as defined in claim 2, wherein shielding means includes a covering surface overlying said cutting means and a fence portion extending normal to said covering surface and away from said cutting means.

4. The cutting tool as defined in claim 3, including holding means extending from said shoulder to maintain said cutting means in cutting stationary position.

5. The cutting tool as defined in claim 4, wherein said shielding means is formed with an oversized bore through which a retaining screw extends through to said base to secure said shielding means on said base with said oversized bore facilitating movement of said shielding means between positions covering and uncovering said cutting means.

6. The cutting tool as defined in claim 5, wherein biasing means is disposed against said retaining screw and within said oversized bore to yieldably bias said shielding means toward a normally covering position over said cutting means.

7. The cutting tool as defined in claim 6, wherein said platform portion is provided with a second grooved or undercut passage adjacent a second shoulder on a remote side of said abutment surface from said cutting means and is further provided with second cutting means and second shielding means disposed on said second shoulder in mirror image to said initially recited cutting means and shielding means.

8. The cutting tool as defined in claim 7, wherein said first and second shielding means are arranged at an angle to each other so that the respective fence portions thereof diverge from a substantially closed rear end to a spread-apart entrance into which a roll of coins may readily be inserted and pressed against said fence portions as such a roll of coins is moved toward said substantially closed rear end to expose said cutting means for cutting operation.

9. The cutting tool as defined in any one of claims 1–8, wherein each of said cutting means is in the form of a blade supported on said at least one shoulder in a plane generally parallel to said abutment surface and at a distance therefrom on the order of the approximate thickness of the crimped end portion of wrappers of packaged rolls of coins and wherein said blades include cutting edges extending along intersecting lines.

10. The cutting tool as defined in any one of claims 4, 5, 6, 7, or 8, wherein said holding means are provided on said shoulders in the form of pins, said shoulders are formed with oversized recesses, said shielding means are provided with guide pin elements and formed with oversized recesses on said covering surface extending around said holding pins, whereby said oversized bore, said oversized recesses of said shielding means will cooperatively accommodate said retaining screw, said guide pin elements, and said holding pins, respectively, during movement of said shielding means between positions covering and uncovering said cutting means.

* * * * *